United States Patent [19]

Bernauer

[11] Patent Number: 4,775,297

[45] Date of Patent: Oct. 4, 1988

[54] NON-CLOGGING IMPELLER FOR USE IN AXIAL AND MIXED-FLOW CENTRIFUGAL PUMPS

[75] Inventor: Jan Bernauer, Bremen, Fed. Rep. of Germany

[73] Assignee: Klein, Schanzlin & Becker Aktiengesellschaft, Frankenthal/Pfalz, Fed. Rep. of Germany

[21] Appl. No.: 24,310

[22] Filed: Mar. 10, 1987

[30] Foreign Application Priority Data

Mar. 12, 1986 [DE] Fed. Rep. of Germany ..... 3608229

[51] Int. Cl.[4] ..... B63H 1/26

[52] U.S. Cl. ..... 416/223 R; 416/223 B; 416/242

[58] Field of Search ..... 415/213 A, 213 B, 213 R; 416/223 B, 223 R, 242

[56] References Cited

U.S. PATENT DOCUMENTS 1,849,127 11/1926 Wood ..... 415/213 R
1,991,095 10/1933 Hochstetter ..... 416/238
2,272,469 2/1942 Lannert ..... 415/213 R
3,081,826 3/1963 Loiseau ..... 416/238
3,367,423 2/1968 Ranst ..... 416/238
4,594,052 6/1986 Niskanen ..... 415/213 A

*Primary Examiner*—Robert E. Garrett
*Assistant Examiner*—Therese Newholm
*Attorney, Agent, or Firm*—Peter K. Kontler

[57] ABSTRACT

The vane of the impeller in a high-speed or mixed-flow centrifugal pump for the conveying of liquids which contain high or low concentrations of strands or strips of vegetable, plastic or other material has a convex inlet edge whose curvature increases gradually in a direction radially outwardly from the axis of rotation at such a rate that the resultant of the centrifugal force and the resistance encountered by a strip or strand at a particular point of the inlet edge is invariably tangential to the respective point of the inlet edge. This ensures that the strips or strands do not overlie and circulate with the inlet edge but are entrained by the resultant force to become separated from the vane. The stagnation paint of the vane in a region which is remote from the axis of rotation is disposed at the suction side of the vane; this also contributes to prevention of accumulation of strips or strands along the inlet edge.

2 Claims, 4 Drawing Sheets

NON-CLOGGING IMPELLER FOR USE IN AXIAL AND MIXED-FLOW CENTRIFUGAL PUMPS

BACKGROUND OF THE INVENTION

The invention relates to improvements in axial- and mixed-flow centrifugal pumps in general, and more particularly to improvements in impellers for use in such pumps. Still more particularly, the invention relates to improvements in the vanes of impellers for use in axial- or mixed-flow centrifugal pumps.

Centrifugal pumps are used for the conveying of fluids which are devoid of solid particles as well as for the conveying of fluids, particularly liquids, which are laden with impurities. Problems arise when the conveyed fluid media contain relatively large quantities of elongated flexible bodies such as strips or strands of plastic material, grass and the like. Elongated flexible bodies tend to gather on the inlet edges of the vanes and to rapidly clog the impeller so as to necessitate an interruption of the operation. The impeller becomes inoperative after a relatively short period of use (e.g., within minutes), especially if the fluid medium contains a large quantity of strip-shaped or like flexible material.

OBJECTS AND SUMMARY OF THE INVENTION

An object of the invention is to provide an axial- or mixed-flow centrifugal pump which can transport or convey fluid media, particularly liquids, containing heavy or extremely heavy concentrations of strip-shaped and like foreign bodies, for any desired period of time without appreciable clogging or without any clogging.

Another object of the invention is to provide a high-speed axial- or mixed-flow centrifugal pump wherein the impeller is constructed in such a way that its vane or vanes are not likely to gather and circulate strips or strands of plastic material, grass and like foreign bodies.

A further object of the invention is to provide a novel and improved vane for use in the impeller of an axial- or mixed-flow centrifugal pump.

An additional object of the invention is to provide a vane for use in the impeller of an axial-or mixed-flow centrifugal pump wherein the inlet edge is configurated and oriented in a novel and improved way.

Still another object of the invention is to provide a novel and improved method of preventing the accumulation of strips or strands of vegetable or other matter along the inlet edges of vanes in the impellers of axial- or mixed-flow centrifugal pumps.

An additional object of the invention is to provide an impeller which is effective to prevent the accumulation of strips or strands of flexible material along the leading edge or edges of its vane or vanes irrespective of the selected rotational speed of the impeller and irrespective of the concentration of foreign bodies in the fluid carrier medium.

The invention is embodied in an impeller for use in an axial- or mixed-flow centrifugal pump, particularly for conveying a fluid medium which contains elongated flexible strands or strips of vegetable or other matter tending to clog the impellers of conventional axial- or mixed-flow centrifugal pumps. The impeller comprises at least one vane which is rotatable about a predetermined axis and has a convex inlet or suction edge whose curvature increases gradually rearwardly in a direction radially outwardly from the predetermined axis at such a rate that the force R at each point of the inlet edge is at least substantially tangential to the inlet edge. The force R is the resultant of forces F and W wherein F is the centrifugal force acting upon a foreign body at the respective point of the inlet edge and W is the resistance which such foreign body encounters at the particular point of the inlet edge to its progress through the impeller in a fluid carrier medium, e.g., in a liquid stream.

In accordance with an additional feature of the invention, the inlet angle of the vane in a region remote from the predetermined axis is preferably such that the stagnation point of the profile of the vane is located at the suction side of the vane. It has been found that such design of the vane even further enhances the conveying of strips, strands or like foreign bodies without the danger of accumulation of these bodies at the inlet edge of the vane.

An axial- or mixed-flow centrifugal pump is preferred for the conveying of fluids which contain strips or strands of vegetable, plastic and like material for reasons of economy.

The novel features which are considered as characteristic of the invention are set forth in particular in the appended claims. The improved centrifugal pump itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
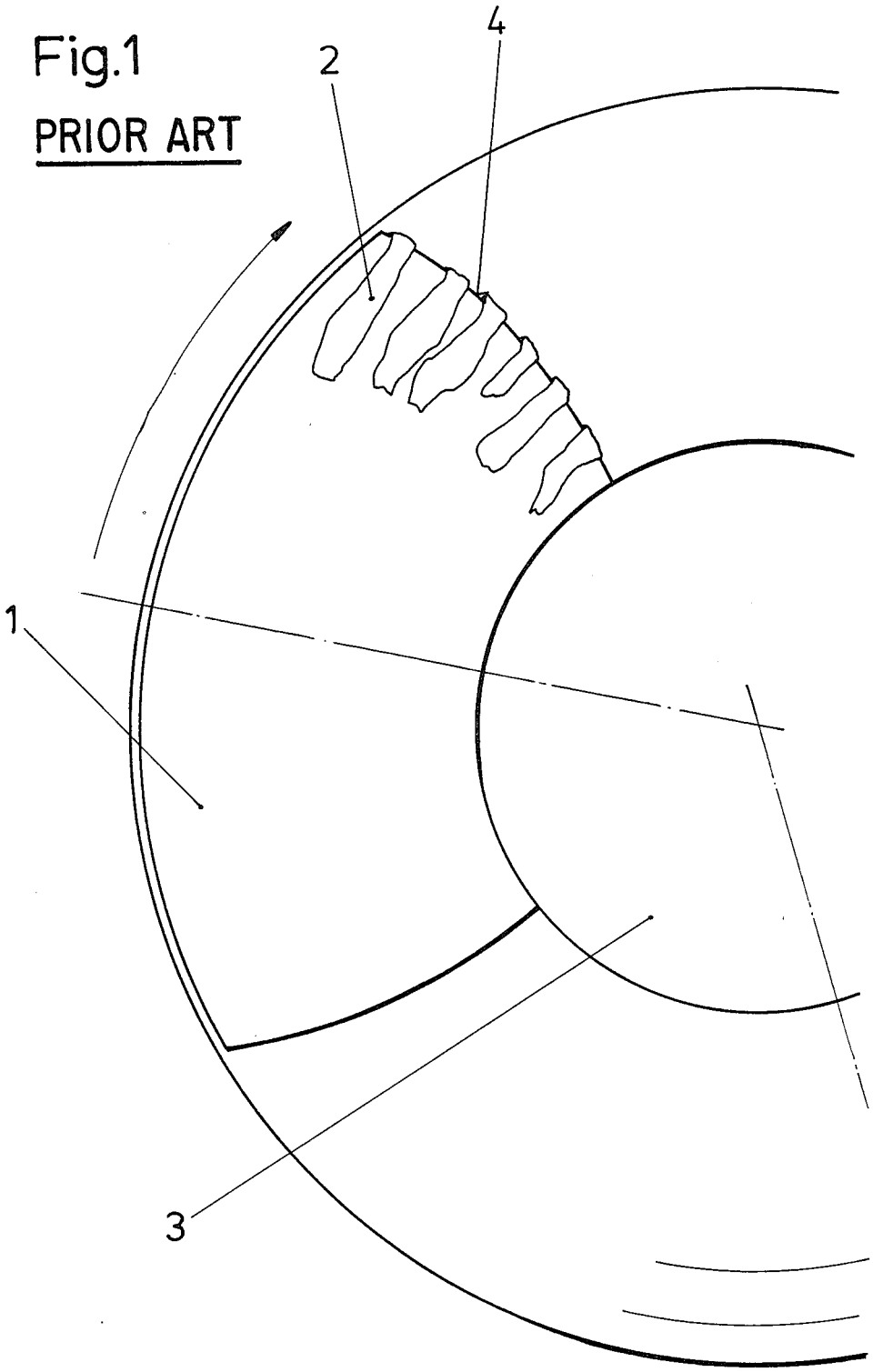
Fig.1 PRIOR ART
FIG. 1 is a fragmentary front elevational view of a conventional impeller with strands of flexible material riding on the illustrated vane in the region of the inlet edge.
Figure 2:
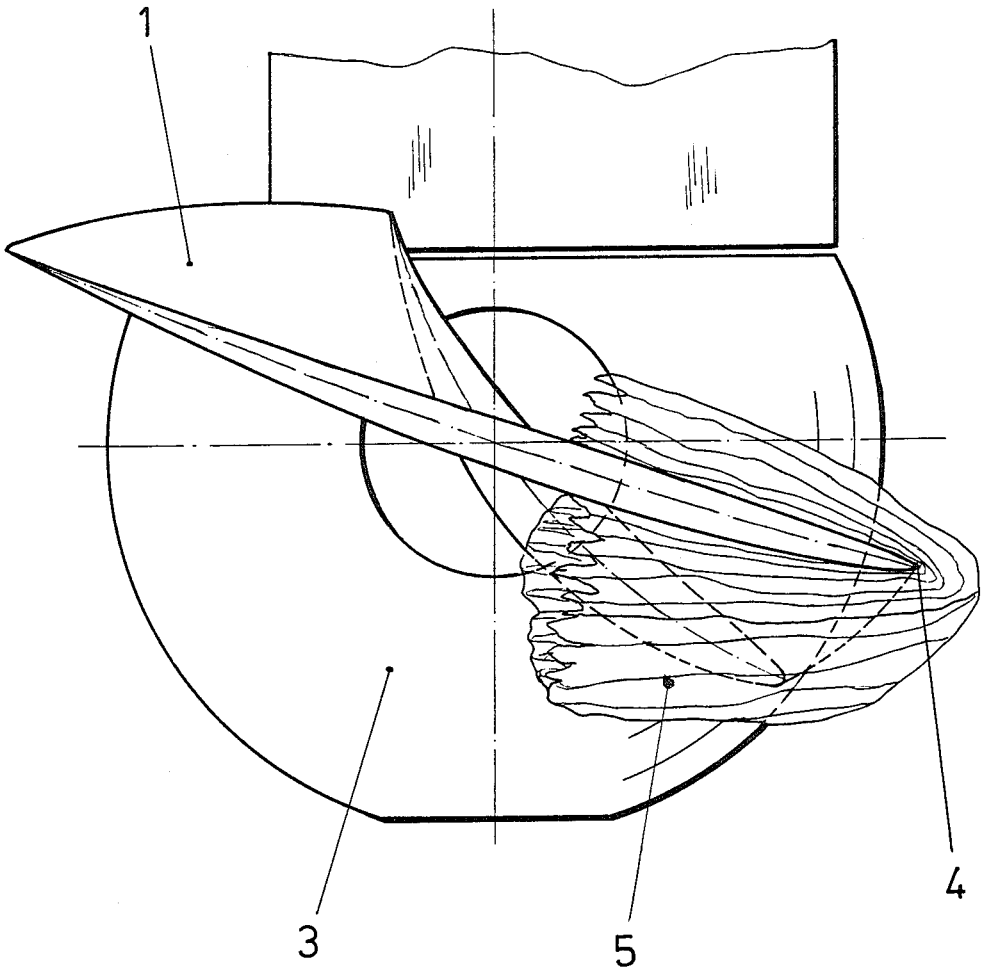
Fig.2 PRIOR ART
FIG. 2 is a view as seen from the left-hand side of FIG. 1 and shows a larger accumulation of elongated flexible material at the inlet edge of the vane.

FIGS. 1 and 2 show a portion of a conventional high-speed axial-flow centrifugal pump having a hub 3 and one or more vanes 1 having inlet edges 4 which are likely to accumulate strips or strands of filamentary and/or fibrous material 2 when the vane or vanes 1 are rotated in a clockwise direction (as seen in FIG. 1). Such material is contained in a liquid medium which is conveyed by the pump. One reason for the accumulation of flexible material 2 on the vane or vanes 1 is that the ratio of peripheral speed to meridian speed of the vane in an axial-flow centrifugal pump is normally five or six to one. Thus, the material 2 will be engaged and entrained by the inlet edge 4 of the vane 1 before it passes through the impeller. If the inlet edge 4 of a vane 1 engages a strip or strand 2 of fibrous material close to the center of gravity of such material, the material continues to adhere to the vane and merely circulates around the hub 3. FIG. 1 shows the initial stage of accumulation of strips or strands 2 of fibrous or filamentary material along the inlet edge 4, and FIG. 2 shows a much more advanced stage of accumulation close to or at the time when the impeller ceases to be operative. Thus, the large package 5 of filamentary or fibrous material 2 which overlies and circulates with the inlet edge 2 renders the impeller and the entire axial-flow pump inoperative. It has been found that such clogging of the impeller takes place shortly after the pump embodying the impeller begins to convey a fluid carrier medium with strands or strips 2 of fibrous or filamentary material therein.

Figure 3:
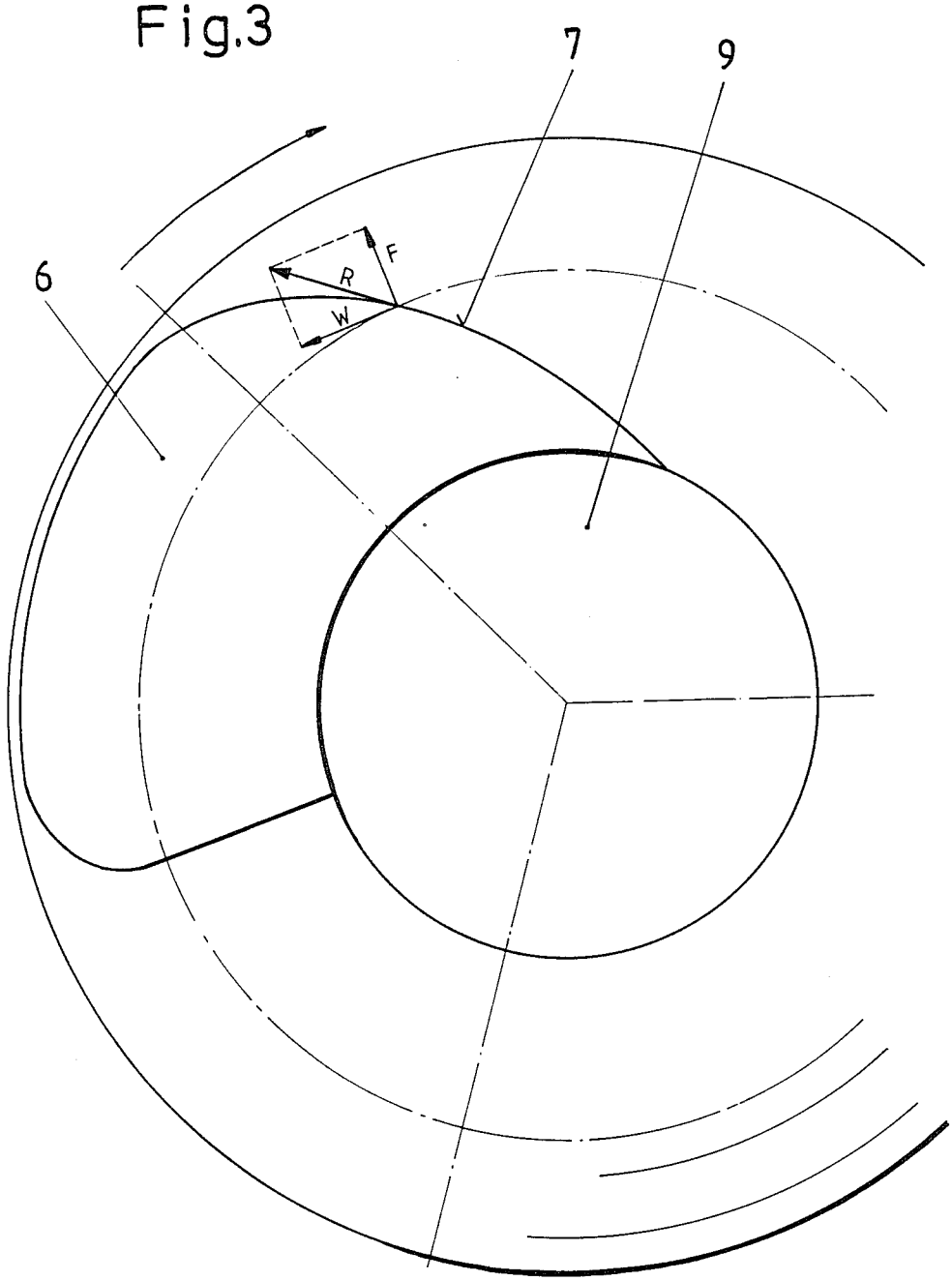
FIG. 3 is a fragmentary front elevational view of an impeller which embodies the invention.

FIG. 3 shows a portion of an impeller which has a hub 9 and at least one vane 6 with a convex inlet edge 7 having a curvature and inclination as proposed in accordance with the present invention. The curvature of the inlet edge 7 increases gradually rearwardly from the hub 9 toward the radially outermost portion of the vane 6 in such a way that the resultant R of forces F and W is at least substantially tangential to the inlet edge 7. The force F is the centrifugal force acting at a selected point of the inlet edge 7, and the force W is indicative of the resistance which the particular point of the inlet edge 7 encounters in a fluid carrier medium. The magnitude of a resultant force R which is tangential to the inlet edge 7 suffices to ensure that an elongated strip, shred or like particle which is engaged by the vane 6 at the respective point of the inlet edge 7 is invariably entrained by such force in the indicated direction before it can settle on the vane 6.

Figure 4:
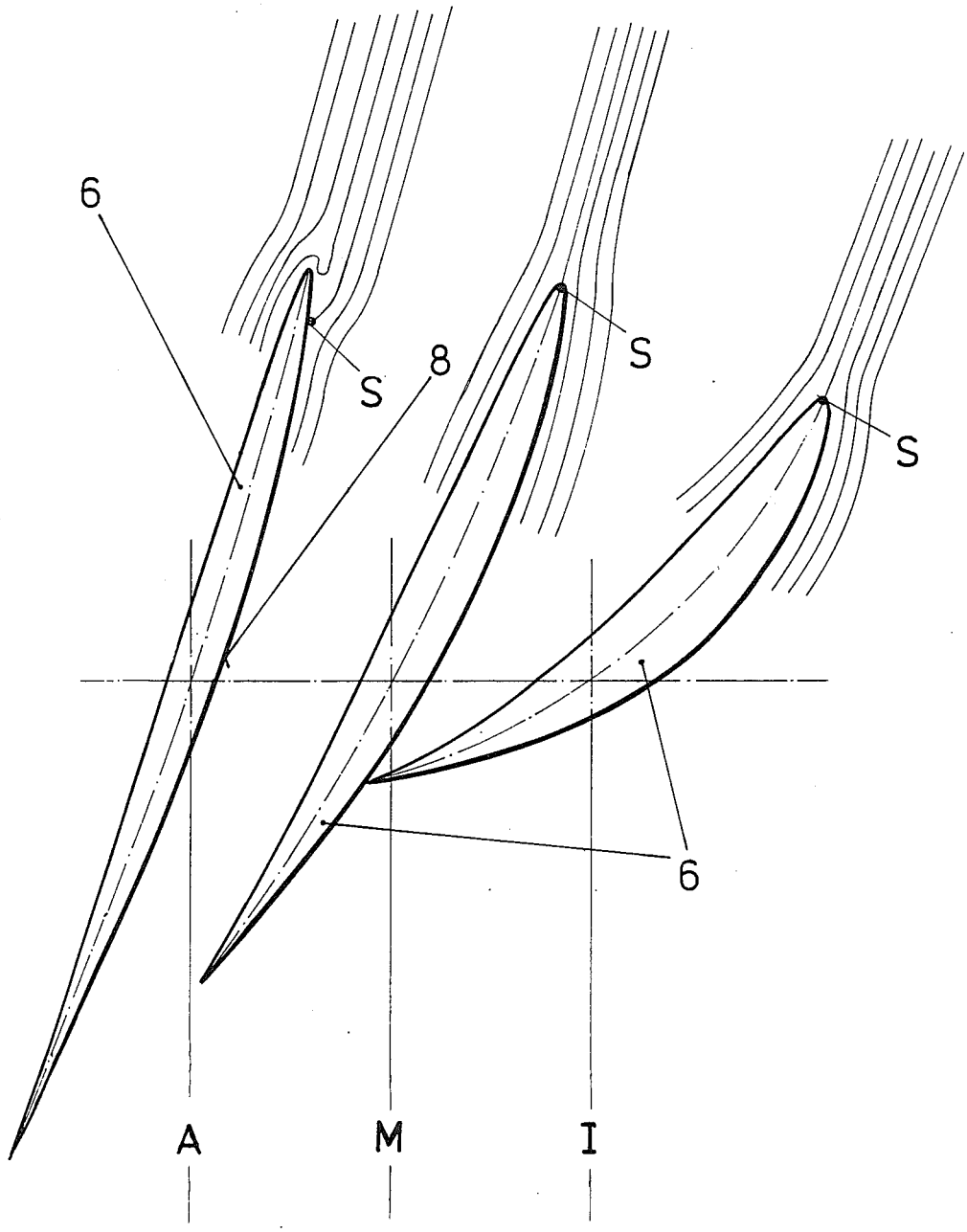
FIG. 4 shows the profiles of the vane of the improved propeller at three different distances from the axis of rotation of the impeller.

FIG. 4 shows the profile of the vane 6 at three locations I, M and A nearest, more distant and most distant from the axis of rotation of the improved impeller. The inlet angle in the radially outer region A of the vane 6 is selected in such a way that the stagnation point S of the profile is located at the suction side 8 of the vane 6. This also contributes to a facilitation of transport of shreds or strips of fibrous or like materials through the impeller.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An impeller for an axial- or mixed-flow centrifugal pump, particularly for conveying a fluid medium which contains elongated flexible strands and like foreign bodies, comprising at least one vane rotatable about a predetermined axis and having a convex inlet edge whose curvature increases in a direction radially outwardly and rearwardly from said predetermined axis in such a manner that a resultant force at least substantially tangential to the inlet edge is generated at each point of the inlet edge.

2. The impeller of claim 1, wherein the inlet angle of said vane in a region which is remote from said axis is such that the stagnation point of the profile of the vane is located at the suction side of the vane.

* * * * *